United States Patent [19]

Hogenkamp et al.

[11] Patent Number: 4,615,164

[45] Date of Patent: Oct. 7, 1986

[54] PACKAGING MACHINE FOR FLAT-SHAPED ARTICLES SUCH AS CHOCOLATE BARS, BOLTS, BLOCKS OR THE LIKE

[75] Inventors: Wilhelm Hogenkamp, Hanover; Manfred Schumann, Garbsen, both of Fed. Rep. of Germany

[73] Assignee: Otto Hänsel GmbH, Hanover, Fed. Rep. of Germany

[21] Appl. No.: 699,207

[22] Filed: Feb. 5, 1985

[30] Foreign Application Priority Data

Feb. 10, 1984 [DE] Fed. Rep. of Germany ..... 3404694

[51] Int. Cl.[4] ..... B65B 65/08; B65B 35/00; B65B 41/02

[52] U.S. Cl. ..... 53/53; 53/223; 53/230; 53/500

[58] Field of Search ..... 53/222, 230, 223, 53, 53/500

[56] References Cited

U.S. PATENT DOCUMENTS 2,883,811 4/1959 Östern ..... 53/522
3,150,474 9/1964 McVicker et al. ..... 53/230 X

*Primary Examiner*—James F. Coan
*Attorney, Agent, or Firm*—Max Fogiel

[57] ABSTRACT

Packaging machine in which the introduction of wrapping material is shaped in such a way that the material can be conveyed to the lower plunger of the packaging machine at minimal expense and over the shortest possible tong path. This object is attained in that the device for supplying the articles and the equipment for introducing the wrapping material operate toward each other in opposite directions.

10 Claims, 2 Drawing Figures

PACKAGING MACHINE FOR FLAT-SHAPED ARTICLES SUCH AS CHOCOLATE BARS, BOLTS, BLOCKS OR THE LIKE

The invention concerns a machine that is intended for packaging articles in the form of slabs, like slabs, bars, or squares of chocolate and similar products, and that includes a device for supplying the articles one after another, equipment for introducing the wrapping material, and a folding mechanism to wrap and seal the wrapping material around each article.

In conventional slab-packaging machines, either the articles and wrapping material are introduced parallel to each other or the introduction system and wrapping-material station are positioned at a right angle to each other. A drawback is that the packaging material must be conveyed only over two stations in the parallel system and over a long transport path in the right-angle system, which is detrimental to the output of the packaging machine.

The object of the invention is to shape the introduction of wrapping material in such a way that the material can be conveyed to the lower plunger of the packaging machine at minimal expense and over the shortest possible tong path.

This object is attained in accordance with the invention in that the device for supplying the articles and the equipment for introducing the wrapping material operate toward each other in opposite directions.

The take-out for the wrapped articles is preferably either above the point where the wrapping material is introduced or above the point where the articles are supplied. A collective packaging machine is annexed in a practical way to the take-out for the wrapped articles.

Another advantage of the system in accordance with the invention is that the supply of articles to be packaged and the introduction of wrapping material advance in an axial direction or in opposition to each other.

A turnstile that accommodates the wrapped articles one after another and testing and sorting units that reject defectively packaged articles are annexed in a practical way to the take-out. A horizontal-stacking device can be positioned downstream of the turnstile.

Figure 1:
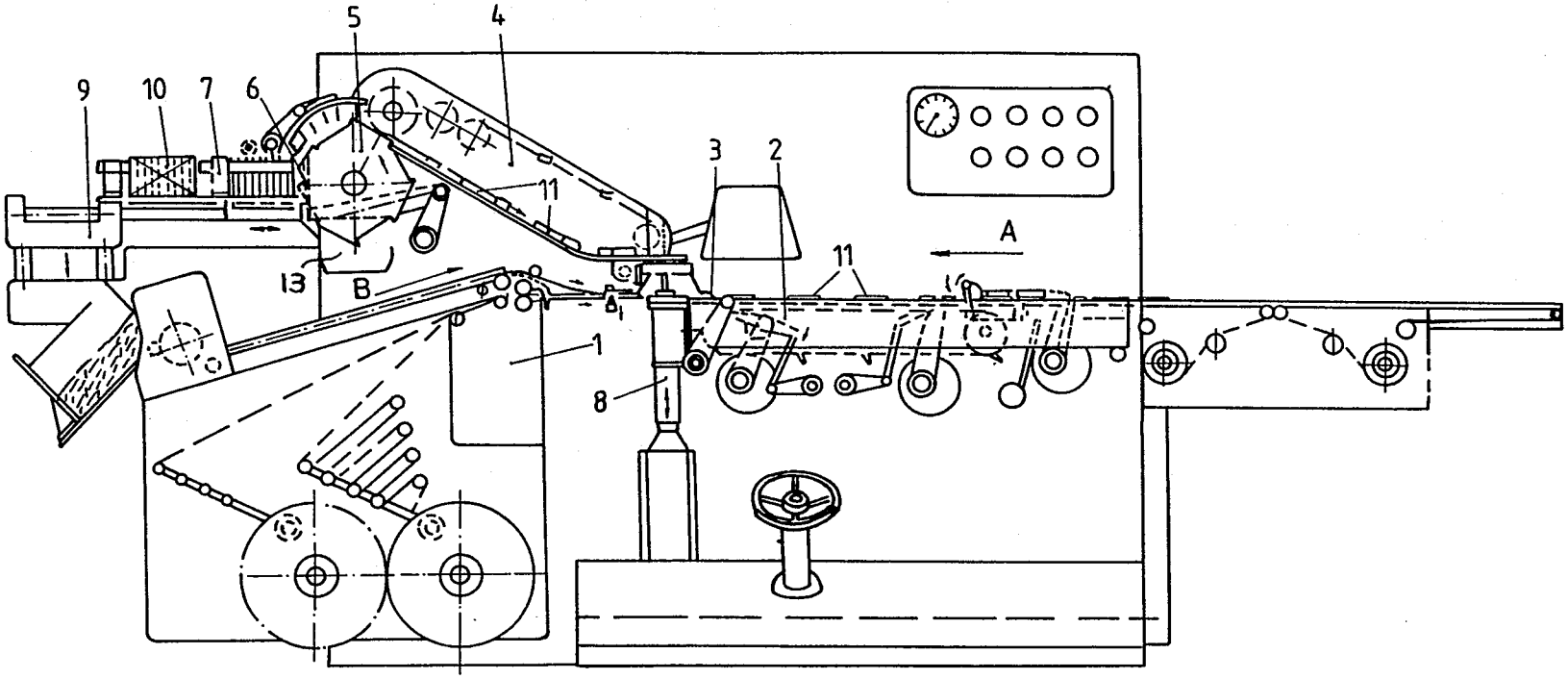
Figure 2:
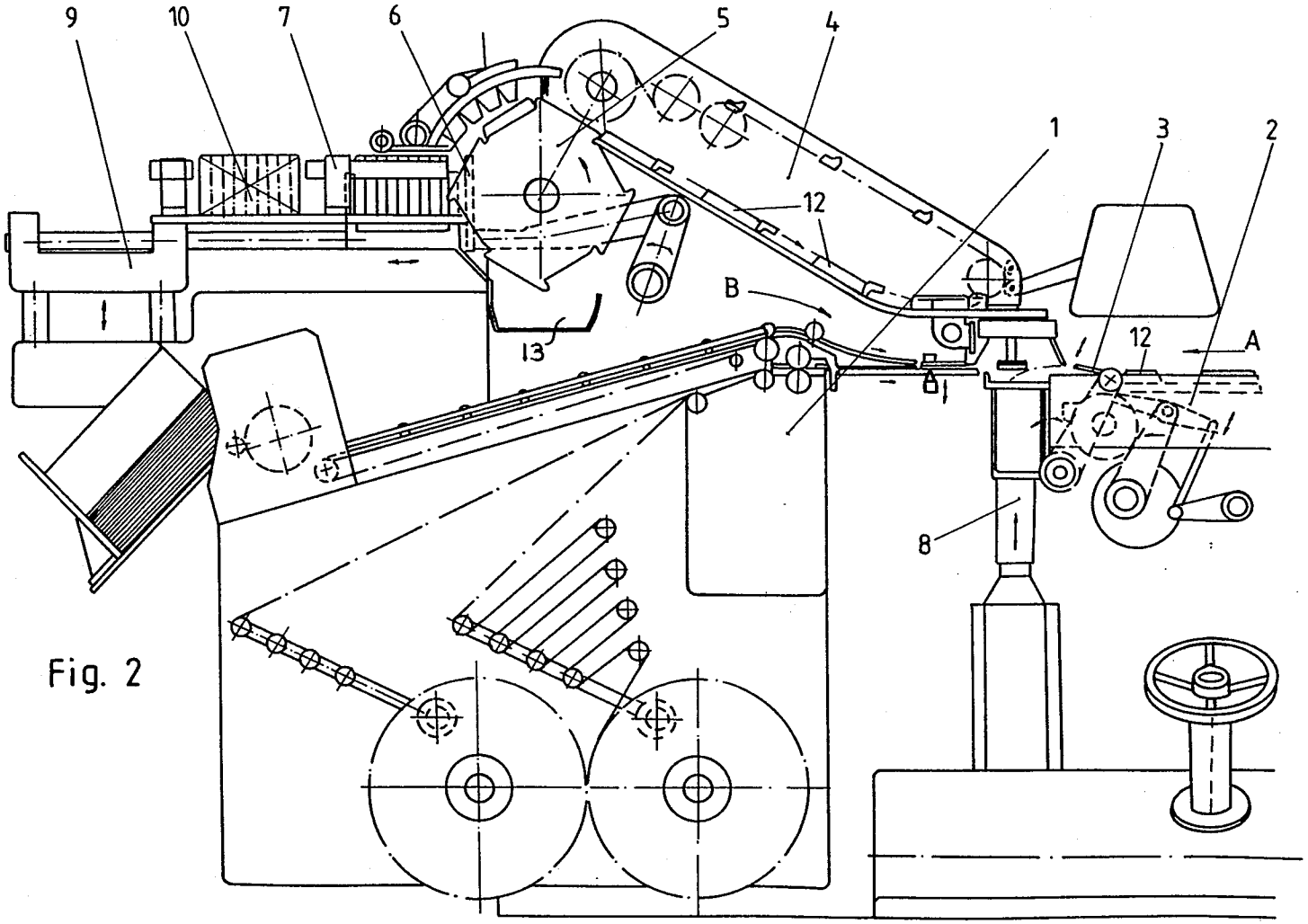

The theory behind the invention, which allows for a wide range of embodiments, is illustrated schematically in the attached drawings, in which FIG. 1 is a side view of a slab-packaging machine in accordance with the invention and FIG. 2 is a larger-scale side view of the major component of the packaging machine.

The device 2 for supplying the unwrapped slabs 11 or bars of chocolate operates along the direction indicated by arrow A toward a lower-plunger station 8 in which blanks of wrapping material are wrapped around the slabs. The products are introduced with a system 3 of tongs with a take-off stroke that is kept minimal in order to advance the blank into lower-plunger station 8.

A wrapping-material station 1 of a design and system that is in itself known is positioned axially opposite. Its sole function is to introduce the requisite blanks of wrapping material, which may be in layers for example, at the correct moment. Since wrapping-material introduction 1 functions in the direction indicated by arrow B, the wrapping material travels in a direction exactly opposite that of the products being wrapped. The take-out 4 of wrapped products 12 occurs in accordance with the invention upward, or above where the wrapping material is introduced. The take-out 4 of wrapped products 12 occurs upward and at an angle, with the wrapped slabs 12 being conveyed by a continuously operating turnstile 5. A horizontal stack 7 of arriving slabs is created by a pusher 6.

The wrapped slabs 12 are tested, especially as to whether an inner wrapper is in place, the outer wrapper has been correctly applied and positioned, and the package is generally in order, on the way from lower-plunger station 8 to turnstile 5. Products that are incorrectly packaged are separated out by turnstile 5 and taken over by an exit chute 13. The pusher 6 that constructs horizontal stack 7 is blocked when the package is not in order. Unexceptably wrapped products 12, on the other hand, are counted and directly transferred by a data-processing system to a collective packaging machine 10.

We claim:

1. Machine for packaging chocolate bars and similar products, comprising means for supplying candy bars one after another; means for supplying wrapping material; folding means to wrap and seal said wrapping material around each candy bar; said means for supplying said candy bars and said means for supplying said wrapping material operating in opposite directions; removal and exit means for removing finished wrapped candy bars; turnstile means connected operatively to said removal means for receiving wrapped candy bars in sequence one-after-another to test and sort wrapped candy bars and reject defectively-packaged candy bars; and horizontal stacking means positioned downstream of said turnstile means.

2. Packaging machine as defined in claim 1, including a counting and stacking system downstream of said turnstile means; and testing and sorting means for transferring a predetermined number of candy bars to a subsequent collective packaging machine.

3. Machine for packaging chocolate bars and similar products, comprising means for supplying candy bars one after another; means for supplying wrapping material; folding means to wrap and seal said wrapping material around each candy bar; said means for supplying said candy bars and said means for supplying said wrapping material operating in opposite directions; transport means for transporting said candy bars and wrapping material over substantially short and straight-lined paths, said paths being arranged all in a single vertical plane, said short and straight-lined paths in said vertical plane holding effects of gravity forces to a minimum for operating the machine at substantially high speed; said wrapping material comprising cut wrapping papers having substantially low stiffness relative to cardboard, said cut wrapping papers being pullable only and being unmovable at high speeds transverse to their surfaces due to substantially high air resistance; and stacking means at the end of the machine for stacking and collecting finished wrapped candy bars.

4. Packaging machine as defined in claim 3, including removal and exit means for removing wrapped candy bars above a point where said wrapping material is supplied.

5. Packaging machine as defined in claim 3, including removal and exit means for removing wrapped candy bars above a point where said candy bars are supplied.

6. Packaging machine as defined in claim 3, including removal and exit means for removing wrapped candy bars; and a collective packaging machine connected operatively to said removal and exit means.

7. Packaging machine as defined in claim 3, wherein said candy bars to be packaged and said cut wrapping papers advance in an axial direction in opposition to each other.

8. Packaging machine as defined in claim 3, wherein said candy bars to be packaged and said cut wrapping papers are positioned operatively in opposition to each other on each side of said folding means.

9. Packaging machine as defined in claim 3, wherein parts of the machine can be folded up or down for maintenance.

10. Machine for packaging chocolate bars and similar products, comprising means for supplying candy bars one after another; means for supplying wrapping material; folding means to wrap and seal said wrapping material around each candy bar; said means for supplying said candy bars and said means for supplying said wrapping material operating in opposite directions; removal and exit means for removing finished wrapped candy bars; turnstile means connected operatively to said removal means for receiving wrapped candy bars in sequence one-after-another to test and sort wrapped candy bars and reject defectively-packaged candy bars; and horizontal stacking means positioned downstream of said turnstile means; transport means for transporting said candy bars and wrapping material over substantially short and straight-lined paths, said paths being arranged all in a single vertical plane, said short and straight-lined paths in said vertical plane holding effects of gravity forces to a minimum for operating the machine at substantially high speed; said wrapping material comprising cut wrapping papers having substantially low stiffness relative to cardboard, said cut wrapping papers being pullable only and being unmovable at high speeds transverse to their surfaces due to substantially high air resistance; and stacking means at the end of the machine for stacking and collecting finished wrapped candy bars; a counting and stacking system downstream of said turnstile means; testing and sorting means for transferring a predetermined number of candy bars to a subsequent collective packaging machine; removal and exit means for removing wrapped candy bars above a point where said wrapping material is supplied; a collective packaging machine connected operatively to said removal and exit means; said candy bars to be packaged and said cut wrapping papers advancing in an axial direction in opposition to each other; said candy bars to be packaged and said cut wrapping papers being positioned operatively in opposition to each other on each side of said folding means; parts of the machine being foldable up or down for maintenance.

* * * * *